US006386086B2

(12) United States Patent
Garcia et al.

(10) Patent No.: US 6,386,086 B2
(45) Date of Patent: May 14, 2002

(54) LINE CHARGE SYMPATHETIC DETONATION ARRESTOR

(75) Inventors: Felipe Garcia, Panama City; Robert Woodall; Christopher Doyle, both of Panama City Beach; John Pipkin, Panama City, all of FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/770,794

(22) Filed: Jan. 29, 2001

Related U.S. Application Data

(63) Continuation-in-part of application No. 09/536,491, filed on Mar. 27, 2000, now Pat. No. 6,321,630, and a continuation-in-part of application No. 09/034,772, filed on Mar. 2, 1998, now Pat. No. 5,959,233, and a continuation-in-part of application No. 09/030,518, filed on Feb. 12, 1998, now abandoned, and a continuation-in-part of application No. 09/012,932, filed on Jan. 24, 1998, now Pat. No. 6,205,903, and a continuation-in-part of application No. 08/944,049, filed on Sep. 12, 1997, now Pat. No. 5,932,835.

(51) Int. Cl.[7] ..... B64D 1/04
(52) U.S. Cl. ..... 89/1.13; 89/1.1
(58) Field of Search ..... 89/1.13, 1.14, 89/1.1; 102/402

(56) References Cited

U.S. PATENT DOCUMENTS 3,730,045 A * 5/1973 Greene et al. ..... 83/580
4,148,257 A * 4/1979 Orill et al. ..... 102/24
5,177,317 A * 1/1993 Walker et al. ..... 89/1.14
5,703,315 A * 12/1997 Coggan ..... 89/1.14

* cited by examiner

*Primary Examiner*—Peter M. Poon
*Assistant Examiner*—M. Thomson
(74) *Attorney, Agent, or Firm*—Harvey A. Gilbert; Donald G. Peck

(57) ABSTRACT

A detonation arrestor cuts the detonating cord of a dud line charge to prevent the pressure wave from a nearby explosion from sympathetically detonating the dud line charge. A housing of the detonation arrestor has a transverse passageway to receive the detonating cord of the dud line charge and an axial bore intersecting the passageway. A cutter piston having a cutter blade is disposed in the bore and is sized to permit axial displacement by a shallow dish-shaped diaphragm spring. The diaphragm spring has its center adjacent to one end of the cutter piston and laterally extends from the bore to be secured to the housing along its round periphery in a sealed relationship. The diaphragm spring is formed in the configuration of a Belleville spring from a spring material providing strength, rigidity, and spring modulus to snap to an extended position when displaced to a position past an over center position by an impinging pressure wave. When the diaphragm spring is displaced by the impinging pressure wave to snap to the extended position, it axially displaces the cutter piston in the bore to cut the detonating cord with the cutter blade and arrest detonation of interconnected ordnance.

13 Claims, 3 Drawing Sheets

LINE CHARGE SYMPATHETIC DETONATION ARRESTOR

CROSS REFERENCE TO RELATED APPLICATIONS

This is a continuation in part of U.S. patent applications entitled "Reliable and Effective Line Charge System" by Felipe Garcia et al., U.S. Patent and Trademark Office Ser. No. 09/012,932 (NC 78,433), filed Jan. 24, 1998, now U.S. Pat. No. 6,205,903 "Line Charge Insensitive Munition Warhead" by Felipe Garcia et al., U.S. Patent and Trademark Office Ser. No. 08/944,049 (NC 78,448), filed Sep. 12, 1997, issued as U.S. Pat. No. 5,932,835, "Line Charge Connector" by Felipe Garcia et al., U.S. Patent and Trademark Office Ser. No. 09/030,518 (NC 78,635), filed Feb. 12, 1998, now abandoned, "Line Charge Fastener and Detonating Cord Guide" by Felipe Garcia et al., U.S. Patent and Trademark Office Ser. No. 09/034,772 (NC 78,878), filed Mar. 2, 1998, issued as U.S. Pat. No. 5,959,233, and "Thermoset/thermoplastic Line Charge with Contoured Fabric Fastening and Detonating Cord Management System and Assembly Process" by Robert Woodall et al., U.S. Patent and Trademark Office Ser. No. 09/536,491 (NC 82,196), filed Mar. 27, 2000, now U.S. Pat. No. 6,321,630 and incorporates all references and information thereof by reference herein.

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to munitions deployed in line charges. In particular, this invention relates to a detonation arrestor responsive to nearby explosions to cut a detonation cord and prevent sympathetic detonation of a line charge.

Often, one or more lanes cleared of mines and obstacles must be secured for an amphibious assault across a beachhead to assure that troops and supplies may safely come ashore. Line charges and systems of line charges are used by the military to create these safe lanes. Usually, several line charges are launched from a relatively safer launch point, e.g. a landing craft air-cushion (LCAC), by rockets that pull line charges out of containers to fly across the surf zone/beachhead and drape over obstacles and mines. The large number of serially connected warheads in each line charge is detonated a short time later via a detonating cord. The exploding warheads clear mines and light obstacles from at least one amphibious assault lane in the water and on land.

The line charges are launched from the LCAC to drape into water and onto land in a lane of a given width, and they are launched in successive echelons from the LCAC as it moves forward. For example, four line charges may be launched from the LCAC in an echelon that extends side by side with one another across the width of the lane and are detonated simultaneously. Then, the LCAC moves forward into this cleared segment of the lane to launch the next echelon of line charges.

However, rocket deployed line charges have varying degrees of reliability since some cannot withstand the rigors of deployment. Consequently, some have been shown to be incapable of detonating reliably and fail. Since the LCAC was never designed to be a heavy amphibious assault craft and, as such, lacks armor, a line charge detonating under or near an LCAC can result in catastrophic destruction of the craft or injury to personnel on the craft.

When line charge systems are launched and detonated in echelons, a dud line charge might turn up. This dud line charge might be in proximity to the LCAC when the next echelon of line charges is launched and detonated. In other words, the LCAC might have moved to a position over the area where the dud line charge from the previous echelon is lying. Detonating line charges of the subsequently deployed echelon of line charges might sympathetically detonate the dud line charge from the previous echelon under the LCAC. This sympathetic detonation could have catastrophic consequences for the LCAC.

Reefing line cutters or explosive diodes might stop the transfer of sympathetic detonation in a detonating cord of a dud line charge. The reefing line cutters could be actuated during the launch of the line charge that became a dud. Explosive diodes could be put in line with the detonating cord but much research and development work needs to be done to modify them to function properly with high output military grade detonating cord. These approaches might compromise the reliability of detonation since they require additional electrical components, power supplies, and interconnections that may not survive launch and deployment themselves.

Thus, in accordance with this inventive concept, a need has been recognized in the state of the art for arrestors that stop sympathetic detonation of unexploded line charges that might be in close proximity to personnel and deploying vehicles such as an LCAC.

SUMMARY OF THE INVENTION

The present invention is directed to providing an arrestor of sympathetic detonation of ordnance. A housing of a detonation arrestor has a transverse passageway to receive detonating cord for the ordnance and an axial bore intersecting the passageway. A cutter piston having a cutter blade is disposed in the bore and is sized for axial displacement by a shallow dish-shaped diaphragm spring. The diaphragm spring has its center adjacent to one end of the cutter piston and laterally extends from the bore to be secured to the housing along its round periphery. When the diaphragm spring is displaced by impinging pressure wave, it snaps to an extended position, it axially displaces the cutter piston in the bore to cut the detonating cord with the cutter blade and arrest detonation of interconnected ordnance.

An object of the invention is to provide an arrestor of sympathetic detonation of ordnance that is simple and efficient.

An object of the invention is to provide an arrestor of sympathetic detonation of ordnance that allows for easy alteration to accommodate any number of different detonating cord sizes and outputs.

An object of the invention is to provide an arrestor of sympathetic detonation of ordnance that can be scaled for application to other systems and is not limited to just cutting detonating cord.

Another object of the invention is to provide a means of cutting a detonating cord in a dud line charge by an impinging pressure wave.

Another object of the invention is to provide a means of cutting a detonating cord in a dud line charge by an impinging pressure wave from a nearby explosion underwater or on land.

Another object of the invention is to provide a means of cutting a detonating cord in a dud line charge by an impinging pressure wave from a nearby explosion underwater or on land to prevent sympathetic detonation thereof.

Another object of the invention is to provide a diaphragm spring in a Belleville washer configuration being responsive to an impinging pressure wave to cut a detonating cord in a dud line charge to prevent sympathetic detonation thereof.

These and other objects of the invention will become more readily apparent from the ensuing specification when taken in conjunction with the appended claims.

DESCRIPTION OF THE PREFERRED EMBODIMENTS

Figure 1:
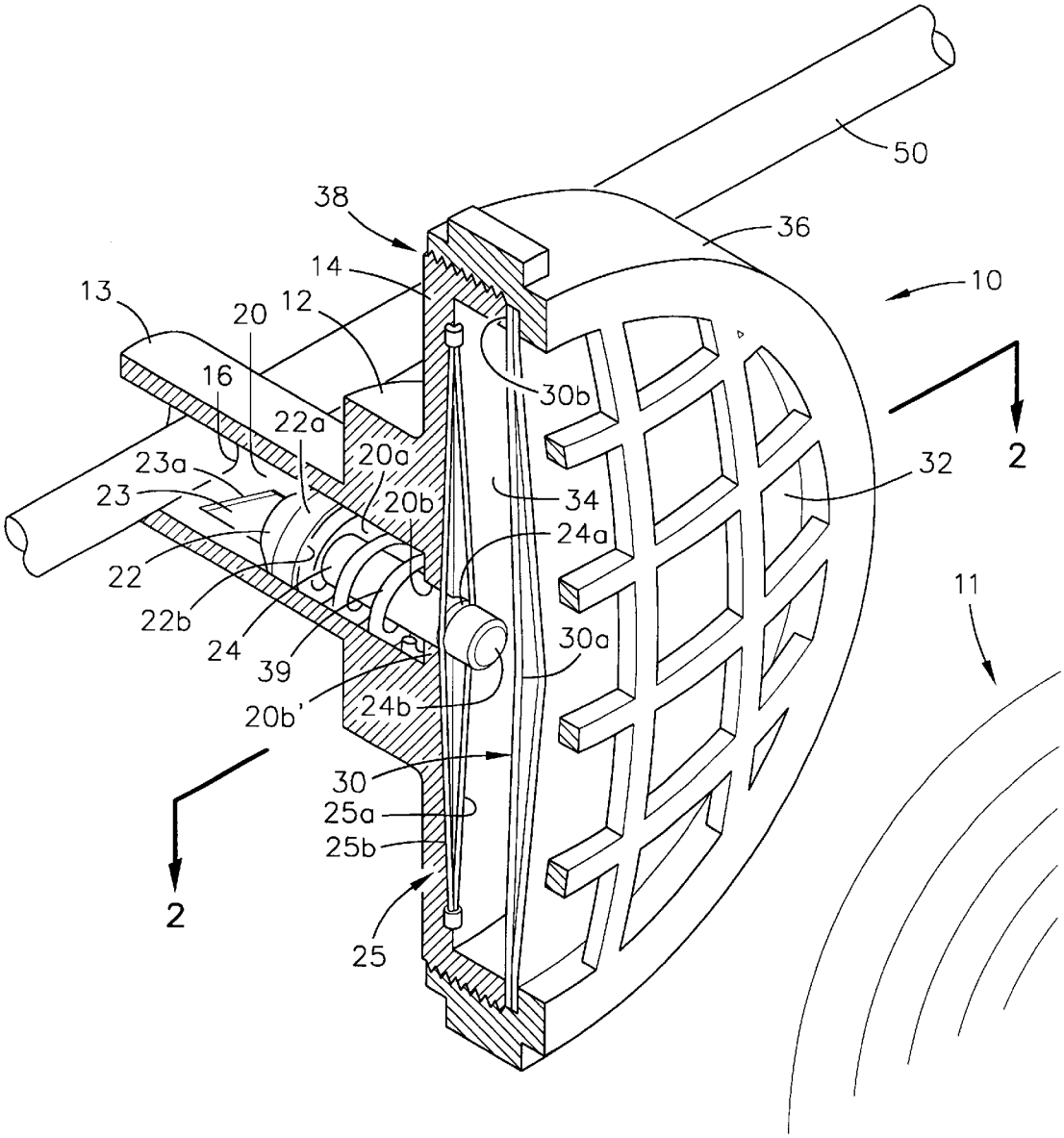
FIG. 1 is an isometric, schematic view, partially in cross section of the detonation arrestor in accordance with this invention.
Figure 2:
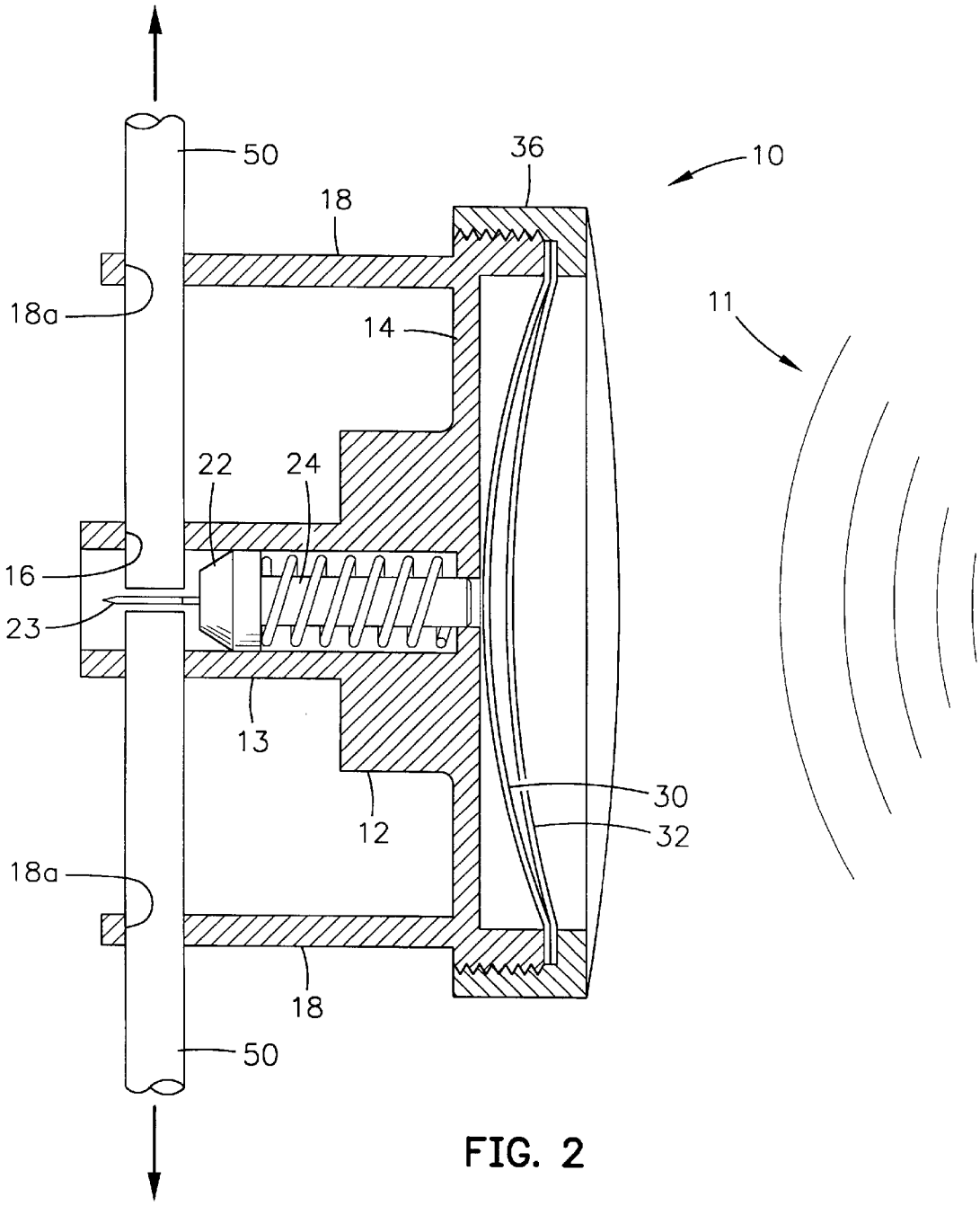
FIG. 2 is a schematic side view taken along line 2—2 in FIG. 1 showing the cutter blade displaced and severing the detonating cord.

Referring to FIGS. 1 and 2 of the drawings, detonation arrestor 10 is operatively disposed with respect to detonating cord 50 to prevent sympathetic detonation of a line charge (not shown). A typical line charge has detonation cord 50 extending through many serially arranged explosive charges, or warheads that are nearly simultaneously detonated by exploding detonating cord 50 to clear a path through obstacles and/or mines. A noteworthy line charge that has proven effectiveness is disclosed in the above referenced, "Reliable and Effective Line Charge System."

Detonation arrestor 10 has a lightweight cylindrical housing 12 having an axially extending portion 13 and a radially extending portion 14. Axially extending portion 13 receives detonating cord 50 through a transverse passageway 16. Passageway 16 may be sized to frictionally engage detonating cord 50 to secure the lightweight detonation arrestor 10 in place on cord 50. Detonation arrestor 10 additionally can have a pair of guide arms 18 having openings 18*a* sized to frictionally engage detonation cord 50, or arms 18 may have some other mechanical clamping adaptation to assist clamping onto detonating cord 50 without damaging it. One or more lightweight detonation arrestors 10 may be placed along the length of cord 50 to cut it in more than one place, if desired.

Axial bore 20 extends through housing 12 of detonating arrestor 10 and intersects transverse passageway 16. A cutter piston 22 made of strong material is disposed in bore 20 and is sized to freely reciprocally, or axially travel in bore 20. An outer surface 22*a* of piston 22 may be provided with a suitable grease-like compound to seal an annular cavity 20*a* in bore 20 from ambient water and air. Triangularly-shaped cutter blade portion 23 having sharpened edge 23*a* is mounted on one end of piston 22, and shaft portion 24 extends from the other end of piston 22 through opening 20*b* of bore 20. Cutter blade 23 can be made from any number of different tough and strong materials that hold an edge. Detonating cord 50 may have a jacket made of strong and abrasion resistant material of man-made high strength fibers marketed under the trademark KEVLAR by E. I. Dupont de Nemours Co., 1007 Market St., Wilmington, Del. 19898. Cutter blade portion 23 may also contain diamond-edged surfaces on sharpened edge 23*a* to effectively cut cord 50.

A circumferential U-shaped groove 24*a* is provided in shaft portion 24, and end 24*b* extends through and outside of opening 20*b*. A catch spring 25 is mounted on opposite ends on radially extending portion 14 to hold its pair of wires 25*a* and 25*b* in tension in U-shaped groove 24*a* on diametrically opposed sides of shaft portion 24. Wires 25*a* and 25*b* of catch spring 25 frictionally engage U-shaped groove 24*a* to retain piston 22, cutter blade portion 23, shaft portion 24 and end 24*b* in the position shown in FIG. 1. This frictional engagement provided by catch spring 25 in groove 24*a* also holds helical booster spring 39 in compression as elaborated on below.

A shallow, dish-shaped diaphragm spring 30 has its center apex 30*a* located adjacent to or in contact with end 24*b* of shaft portion 24 of piston 22 and laterally extends from bore 20. Diaphragm spring 30 laterally extends from bore 20 and is secured along its round periphery 30*b* in a sealed relationship, as explained below. Diaphragm spring 30 is made from stainless steel or any other suitable material that provides strength, rigidity and spring modulus when formed into a Belleville spring configuration that snaps into an extended position when it is displaced to a position past a center, or over center position for diaphragm spring 30. The center, or over center position is defined as the position of diaphragm spring 30 when center apex 30*a* and round periphery 30*b* lie in virtually the same plane. Diaphragm spring 30 is shown in FIG. 1 as having center apex 30*a* extending away from radially extending portion 14. An incoming, or impinging pressure wave 11 will displace it inwardly and toward end 24*b* of shaft portion 24. When diaphragm spring 30 has been displaced to an over-center position to the left, apex 30*a* bears and pushes against end 24*b* of shaft portion 24, the frictional engagement of catch spring 25 in U-shaped groove 24*a* is overcome, and diaphragm spring 30 snaps to an extended position to the left as shown in FIG. 2. This force displaces piston 22 to the left and sharpened edge 23*a* of cutter blade 23 severs detonating cord 50.

Optionally, opening 20*b* may be smaller that bore 20 to provide a rim 20*b*′ to retain a helical booster spring 39 in compression between it and annular shoulder 22*b* of piston 22. The biasing force exerted by booster spring 39 may be used to supplement, or augment the force exerted by diaphragm spring 30 when incoming, or impinging pressure wave 11 pushes against diaphragm spring 30 to overcome the frictional engagement of wires 25*a* and 25*b* of catch spring 25 in U-shaped groove 24*a* and trigger, or allow diaphragm spring 30 to snap to the left. The combined forces provided by the triggered, or snapped diaphragm spring 30 and booster spring 39 are sufficient to displace piston 22 to the left and sever detonating cord 50 with cutter blade portion 23.

Cutting blade 23 can have a variety of configurations, such as flat, serrated, inclined, or triangular, as shown. It can be shaped to lie so that as the positive portion of incoming pressure wave 11 moves it across detonating cord 50, cutter blade 23 cuts detonating cord 50 one-way, and then when the negative portion of the incoming pressure wave 11 occurs, piston 22 attached to cutter blade 23 is pulled in reverse and blade 23 cuts detonating cord 50 again in the other way as it moves back to its original position. Cutter blade 23 cuts in both directions to increase the reliability of severing detonating cord 50.

A flexible diaphragm 32 may be disposed adjacent diaphragm spring 30. Flexible diaphragm 32 may be made from a suitable waterproof, or water-resistant fabric or flexible sheet to protect diaphragm spring 30 from the ambient and to provide watertight integrity of chamber 34.

A protective grill cap 36 is secured to radially extending portion 14 via mating threads 38. Protective grill cap 36 defines sufficient openings 36*a* to pass incoming pressure wave 11 to allow displacement of diaphragm spring 30. Grill cap 36 can have a sealant (not shown) sandwiched in mating threads 38 to not only hold diaphragm spring 30 and flexible diaphragm 32 tightly on radially extending portion 14 but also to seal round periphery 30*b* of diaphragm spring 30 to housing 12 so that both chamber 34 and annular cavity 20*a* maintain their sealed relationship with respect to ambient water or air.

Detonation arrestor 10 makes use of incoming, or impinging pressure wave 11 that naturally occurs when nearby explosives explode. Pressure wave 11 travels outward from the point of detonation and raises the pressure along a three-dimensional front as it moves away. Sympathetic detonation arrestor 10 of this invention makes use of this high pressure front 11 to move flexible diaphragm 32 and diaphragm spring 30, snap the Belleville washer configured diaphragm spring 30, and rapidly move piston 22 and very sharp cutting blade 23 to completely sever detonating cord 50 and cut off the detonation transfer train. This happens prior to the passing of any sympathetic detonation front.

Detonating arrestor 10 is simple and efficient and allows for easy alteration to accommodate any number of different detonating cord sizes and outputs. Detonation arrestor 10 provides a means of cutting a detonating cord of a dud line charge in the event of a nearby underwater explosion sufficient to initiate the dud line charge to thereby prevent sympathetic detonation of the dud line charge. Detonation arrestor 10 serves to stop sympathetic detonation from occurring in close proximity to LCAC and reduces the risk to the craft due to hazards of sympathetic detonation. Detonating arrestor 10 also can be scaled for application to other systems and is not limited to just cutting detonating cord.

Figure 3:
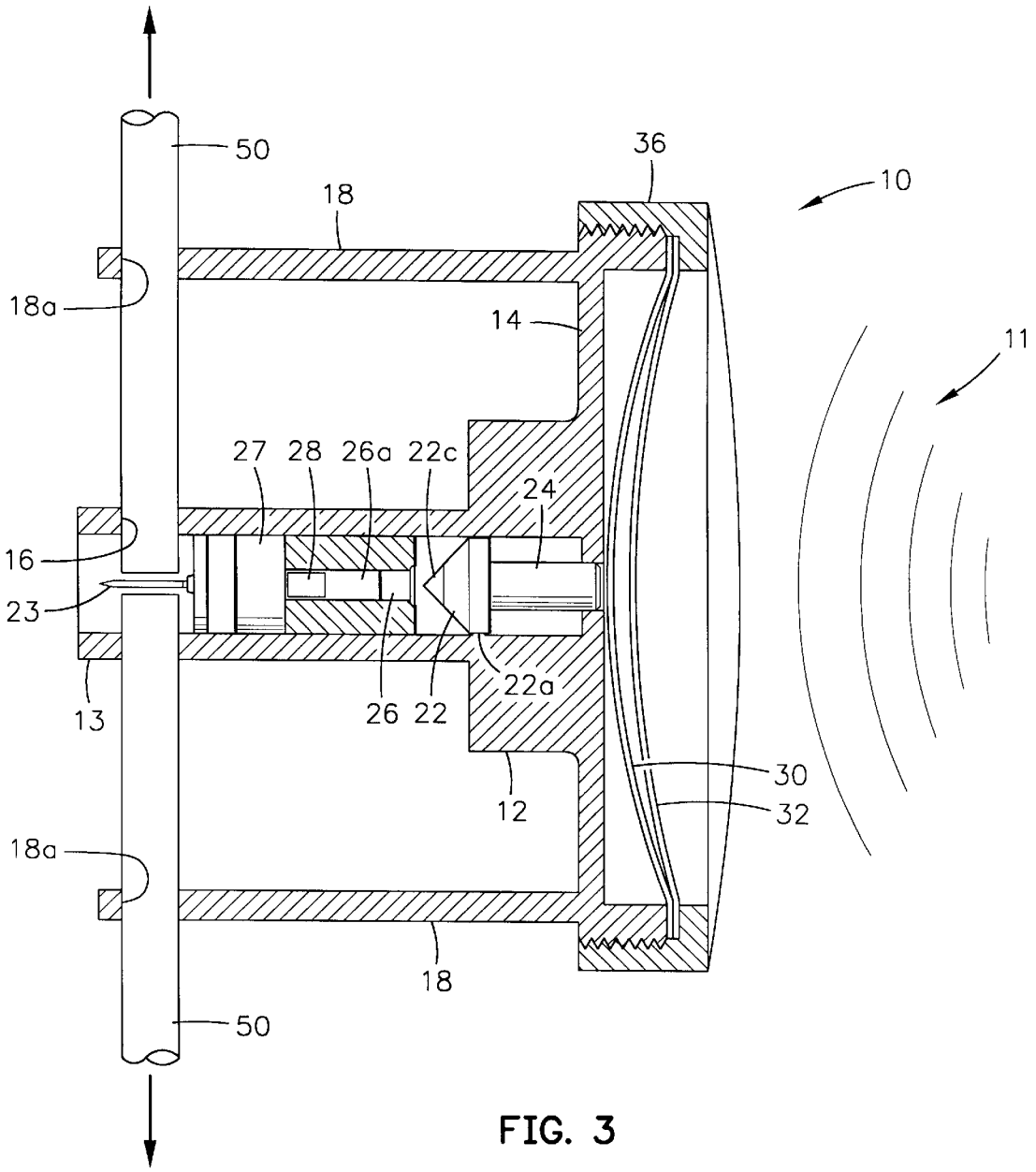
FIG. 3 is a schematic side view taken along line 2—2 in FIG. 1 showing a variation of the detonation arrestor.

FIG. 3 shows another option that has piston 22 in a modified housing 12 provided with a firing pin 22*c* to strike and detonate a percussion cap, or primer 26. As impinging pressure wave 11 snaps diaphragm spring 30 and piston 22 to the left, firing pin 22*c* initiates percussion cap 26 and the flash from exploding cap 26 passes through flash hole 26*a* to detonate detonator 27. The forceful explosion of detonating detonator 27 forcefully propels cutter blade 23 to the left to cut detonating cord 50. Since the levels of cutting energy created by different ones of detonator 27 are known, the right detonator 27 can be selected to reliably cut detonating cord 50 regardless of pressure wave activation energy from pressure wave 11 or the size and/or strength of detonating cord 50.

A variation of the option of FIG. 3 could also have a pyrotechnic delay line element 28 in flash hole 26*a* that is ignited by the flash of percussion cap 26. Pyrotechnic delay line element 28 allows for a delayed actuation of detonator 27 such that a single impinging pressure wave 11 initiated on-command could be used to activate several detonation arrestors 10 in a sequence or nearly simultaneously. In addition, other firing devices and detonation arrestors 10 could be actuated in predetermined patterns to cut cord 50 and other cords as needed during different tactical scenarios.

Accordingly, having this disclosure in mind, one skilled in the art to which this invention pertains will select and assemble various components from among a wide variety available in the art. Therefore, this disclosure is not to be construed as limiting, but rather, is intended to be demonstrative of this inventive concept.

It should be readily understood that many modifications and variations of the present invention are possible within the purview of the claimed invention. It is to be understood that within the scope of the appended claims the invention may be practiced otherwise than as specifically described.

We claim:

1. A detonation arrestor comprising:

a housing having a transverse passageway to receive a detonating cord extending to ordnance and an axial bore intersecting said passageway;

a cutter piston disposed in said bore being sized to permit axial displacement therein and having a cutter blade adjacent said passageway; and a shallow dish-shaped diaphragm spring having its center adjacent to one end of said cutter piston, said diaphragm spring laterally extending from said bore and being secured to said housing along its round periphery in a sealed relationship.

2. A detonation arrestor according to claim 1 wherein said diaphragm spring is formed in the configuration of a Belleville spring from a spring material providing strength, rigidity, and spring modulus to snap to an extended position when said diaphragm spring is displaced to a position past an over center position spring by an impinging pressure wave.

3. A detonation arrestor according to claim 2 wherein said diaphragm spring is displaced by said impinging pressure wave to snap to said extended position to axially displace said cutter piston in said bore and cut said detonating cord with said cutter blade to arrest detonation of said ordnance.

4. A detonation arrestor according to claim 3 wherein said housing is adapted to engage said detonating cord extending therethrough.

5. A detonation arrestor according to claim 4 further comprising:

a catch spring connected to said housing and having a pair of wires in tension frictionally engaging a U-shaped groove in a shaft portion of said piston in said bore, said wires of said catch spring being disengaged from said bore to permit said axial displacement of said piston therein to cut said detonating cord with said cutter blade.

6. A detonation arrestor according to claim 5 further comprising:

a flexible diaphragm extending across said housing to protect said diaphragm spring.

7. A detonation arrestor according to claim 6 further comprising:

a protective grill extending across said housing to protect said flexible diaphragm and said diaphragm spring.

8. A detonation arrestor according to claim 7 wherein said catch spring is a pair of wires held in tension to frictionally engage a U-shaped groove in said piston and retain one end of said shaft portion of said piston in contact with the center of said diaphragm spring.

9. A detonation arrestor according to claim 8 further comprising:

a helical booster spring wrapped about said shaft portion of said cutter pistons being held in compression to augment the force provided by said diaphragm spring to help cut said detonating cord.

10. A detonation arrestor according to claim 9 wherein said protective grill engages said housing to internally seal a chamber inside said diaphragm spring and an annular cavity in said bore.

11. A detonation arrestor according to claim 10 further comprising:

a percussion cap adjacent said piston having a firing hole extending therefrom;

a detonator disposed at one end of said firing hole and adjacent said cutter blade; and a firing pin on said piston being disposed adjacent said percussion cap.

12. A detonation arrestor according to claim 11 wherein said firing pin is displaced by said diaphragm spring to initiate said percussion cap to detonate said detonator and forcefully propel said cutter blade to cut said detonating cord.

13. A detonation arrestor according to claim 12 further comprising:

a pyrotechnic delay line element disposed in said flash hole.

* * * * *